US011892007B2

(12) United States Patent
Ling et al.

(10) Patent No.: US 11,892,007 B2
(45) Date of Patent: Feb. 6, 2024

(54) IMPELLER

(71) Applicant: Delta Electronics, Inc., Taoyuan (TW)

(72) Inventors: Wei-I Ling, Taoyuan (TW); Chao-Fu Yang, Taoyuan (TW); Chih-Chung Chen, Taoyuan (TW); Kuo-Tung Hsu, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 18/184,344

(22) Filed: Mar. 15, 2023

(65) Prior Publication Data

US 2023/0220850 A1 Jul. 13, 2023

Related U.S. Application Data

(63) Continuation of application No. 17/391,739, filed on Aug. 2, 2021, now Pat. No. 11,635,086.

(30) Foreign Application Priority Data

Feb. 9, 2021 (CN) ..... 202110181727.4

(51) Int. Cl.

| | |
|---|---|
| ***F04D 29/26*** | (2006.01) |
| ***F04D 29/52*** | (2006.01) |
| ***F04D 19/00*** | (2006.01) |
| ***F04D 29/32*** | (2006.01) |
| ***F04D 17/08*** | (2006.01) |
| ***F04D 29/02*** | (2006.01) |
| ***F04D 29/054*** | (2006.01) |

(52) U.S. Cl.

CPC ..... *F04D 29/263* (2013.01); *F04D 17/08* (2013.01); *F04D 19/002* (2013.01); *F04D 29/023* (2013.01); *F04D 29/054* (2013.01); *F04D 29/325* (2013.01); *F04D 29/522* (2013.01)

(58) Field of Classification Search

CPC .... F04D 29/263; F04D 19/062; F04D 29/325; F04D 29/522

See application file for complete search history.

(56) References Cited

U.S. PATENT DOCUMENTS

| | | | | |
|---|---|---|---|---|
| 7,122,924 | B2 * | 10/2006 | Lee | H02K 9/06 310/58 |
| 9,568,008 | B2 * | 2/2017 | Huang | F04D 29/263 |
| 11,401,941 | B2 * | 8/2022 | Saito | F04D 25/064 |

* cited by examiner

*Primary Examiner* — Sabbir Hasan

(74) *Attorney, Agent, or Firm* — Muncy, Geissler, Olds & Lowe, P.C.

(57) ABSTRACT

An impeller is provided, including a metal housing, a shaft, and a plastic member. The metal housing has a shaft mounting hole. The inner surface of the shaft mounting hole includes three or more contact points, and the contact points are closer to the shaft than other portions of the inner surface of the shaft mounting hole. The shaft passes through the shaft mounting hole and is affixed by the contact points. The metal housing divides the shaft into an upper section, a middle section, and a lower section. The plastic member passes through the shaft mounting hole and is in contact with the middle section.

15 Claims, 6 Drawing Sheets

IMPELLER

CROSS REFERENCE TO RELATED APPLICATIONS

This application is a Continuation of application Ser. No. 17/391,739, filed on Aug. 2, 2021, which claims the benefit of China Patent Application No. 202110181727.4, filed Feb. 9, 2021, the entirety of which is incorporated by reference herein.

BACKGROUND OF THE INVENTION

Field of the Invention

The application relates in general to an impeller, and in particular, to an impeller having a metal housing.

Description of the Related Art

Electronic devices are being developed to provide better performance, be lighter, and have a thinner structure. However, these features can increase the internal operating temperature of the electronic devices, making them unstable and thus affecting their reliability. Therefore, existing electronic devices are usually equipped with a fan to dissipate the generated heat.

Some fans include a metal case for preventing electromagnetic interference. However, connecting the metal case to the shaft can be difficult, and the cost of manufacturing may increase. Therefore, how to address the aforementioned problem has become an important issue.

BRIEF SUMMARY OF INVENTION

To address the deficiencies of conventional products, an embodiment of the invention provides an impeller, including a metal housing, a shaft, and a plastic member. The metal housing has a shaft mounting hole. The inner surface of the shaft mounting hole includes three or more contact points, and the contact points are closer to the shaft than other portions of the inner surface of the shaft mounting hole. The shaft passes through the shaft mounting hole and is affixed by the contact points. The metal housing divides the shaft into an upper section, a middle section, and a lower section. The plastic member passes through the shaft mounting hole and is in contact with the middle section.

In some embodiments, the plastic member is in contact with the inner surface. Two or more contact portions are formed on the inner surface, and the contact points are formed on the contact portion. The contact areas, the dimensions, or the shapes of two of the contact portions are different. An embossing texture is formed on the shaft or the inner surface, and at least a portion of the embossing texture is in contact with the plastic member. The plastic member is extended to contact at least a portion of the upper section or a portion of the lower section. The metal housing has an upper surface and a lower surface opposite to the upper surface. The upper section protrudes from the upper surface, and the lower section protrudes from the lower surface. The plastic member is also in contact with the upper surface and the lower surface.

An impeller is also provided, including a metal housing, a shaft, and a plastic member. A contact portion is formed on the inner surface of the shaft mounting hole. The shaft passes through the shaft mounting hole and is affixed by the contact portion. The metal housing divides the shaft into an upper section, a middle section, and a lower section. The plastic member passes through the shaft mounting hole and is in contact with the middle section.

In some embodiments, the plastic member is in contact with the inner surface. The opening of the shaft mounting hole is a polygonal opening. An embossing texture is formed on the shaft or the inner surface, and at least a portion of the embossing texture is in contact with the plastic member. The plastic member is extended to contact at least a portion of the upper section or a portion of the lower section. The metal housing has an upper surface and a lower surface opposite to the upper surface. The upper section protrudes from the upper surface, and the lower section protrudes from the lower surface. The plastic member is also in contact with the upper surface and the lower surface. The thickness of the contact portion is less than the thickness of the metal housing at the periphery of the shaft mounting hole.

An impeller is further provided, including a metal housing, a shaft, and a plastic member. The metal housing has a shaft mounting hole. The opening of the shaft mounting hole is a polygonal opening. The shaft passes through the shaft mounting hole and is affixed by the shaft mounting hole. The metal housing divides the shaft into an upper section, a middle section, and a lower section. The plastic member passes through the shaft mounting hole and is in contact with the middle section.

In some embodiments, the plastic member is in contact with the inner surface of the shaft mounting hole. The plastic member is extended to contact at least a portion of the upper section or a portion of the lower section. An embossing texture is formed on the shaft or the inner surface of the shaft mounting hole, and at least a portion of the embossing texture is in contact with the plastic member. The metal housing has an upper surface and a lower surface opposite to the upper surface. The upper section protrudes from the upper surface, and the lower section protrudes from the lower surface. The plastic member is also in contact with the upper surface and the lower surface.

BRIEF DESCRIPTION OF DRAWINGS

The invention can be more fully understood by reading the subsequent detailed description and examples with references made to the accompanying drawings, wherein.

DETAILED DESCRIPTION OF INVENTION

Unless defined otherwise, all technical and scientific terms used herein have the same meaning as commonly understood by one of ordinary skill in the art to which this invention belongs. It should be appreciated that each term, which is defined in a commonly used dictionary, should be interpreted as having a meaning conforming to the relative skills and the background or the context of the present disclosure, and should not be interpreted in an idealized or overly formal manner unless defined otherwise.

Figure 1:
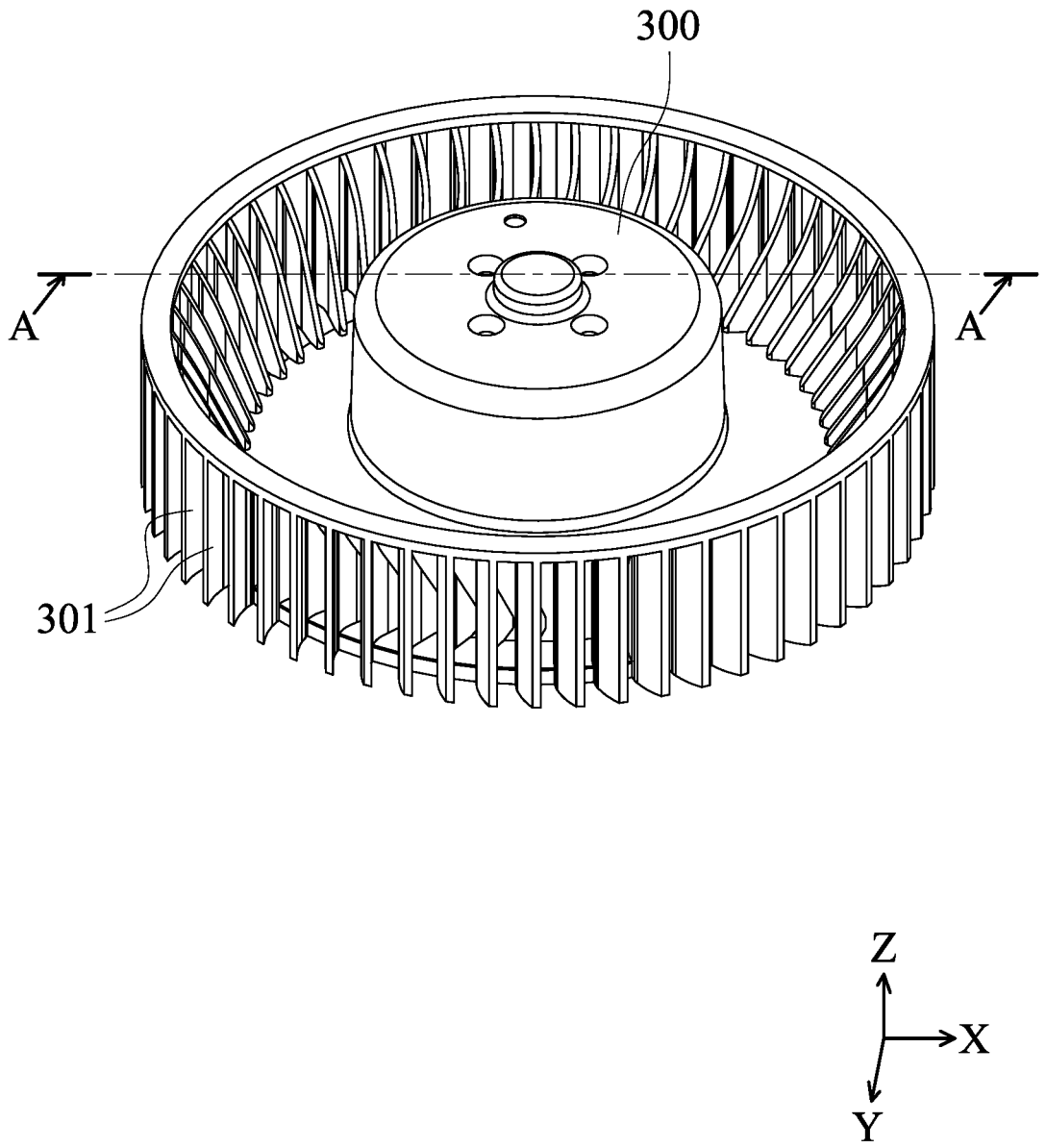
FIG. 1 is a schematic diagram of an impeller according to an embodiment of the invention.
Figure 2:
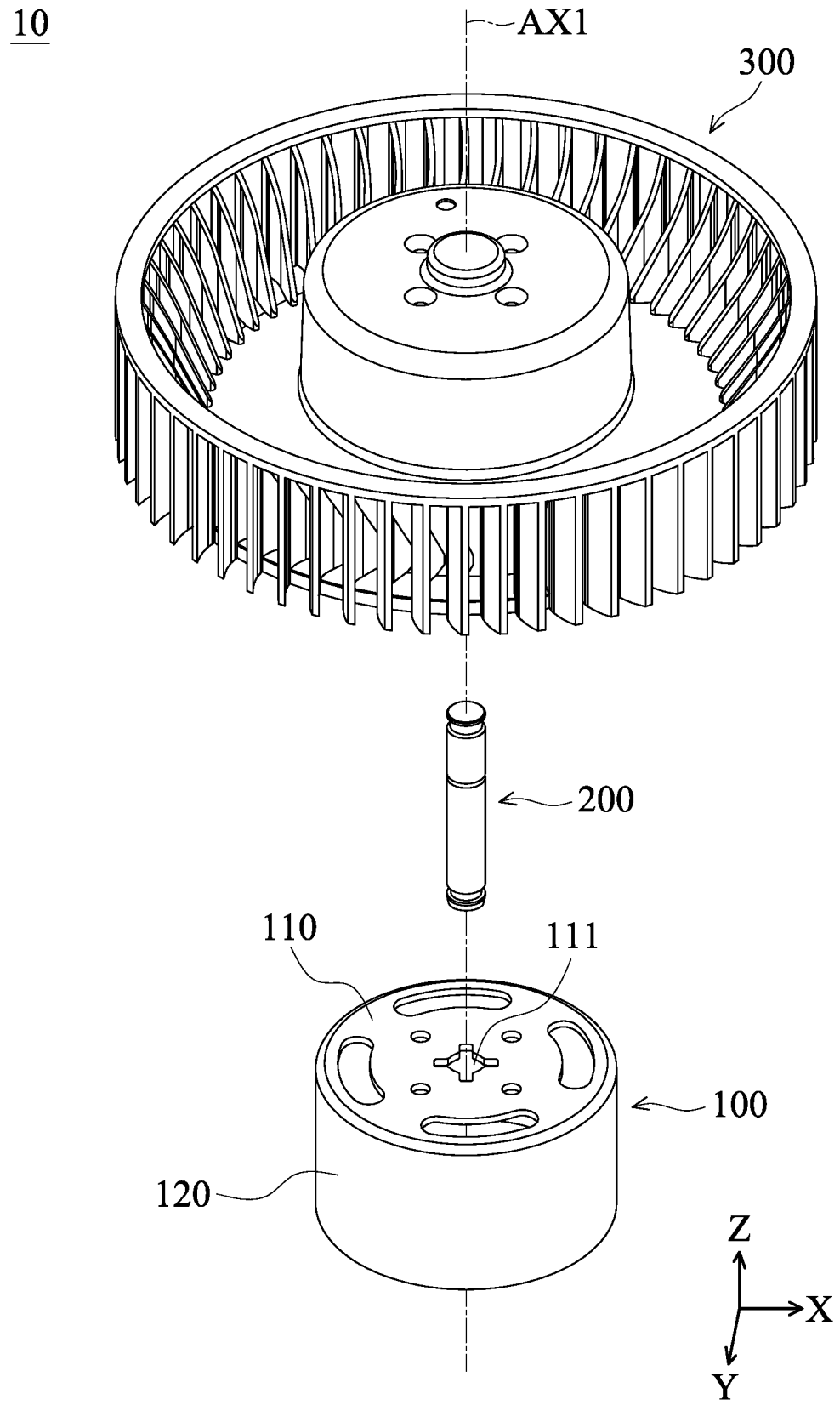
FIG. 2 is an exploded-view diagram of the impeller according to an embodiment of the invention.

FIG. 1 is a schematic diagram of an impeller 10 according to an embodiment of the invention, and FIG. 2 is an exploded-view diagram of the impeller 10. Referring to FIG. 1 and FIG. 2, the impeller 10 primarily includes a metal housing 100, a shaft 200, and a plastic member 300. The metal housing 100, the shaft 200, and the plastic member 300 can be affixed to each other. The impeller 10 can be pivotally connected to a driving module (such as a motor) via the shaft 200, so as to rotate the impeller 10.

The impeller 10 can be used in a fan system, which is applied to dissipate heat (for example, the fan system disposed in a personal computer, a notebook computer, or a server rack), ventilate (for example, the fan system disposed on a ventilation window), or pressurize (for example, the fan system disposed in a pump or a vacuum cleaner), but it is not limited thereto.

Figure 3:
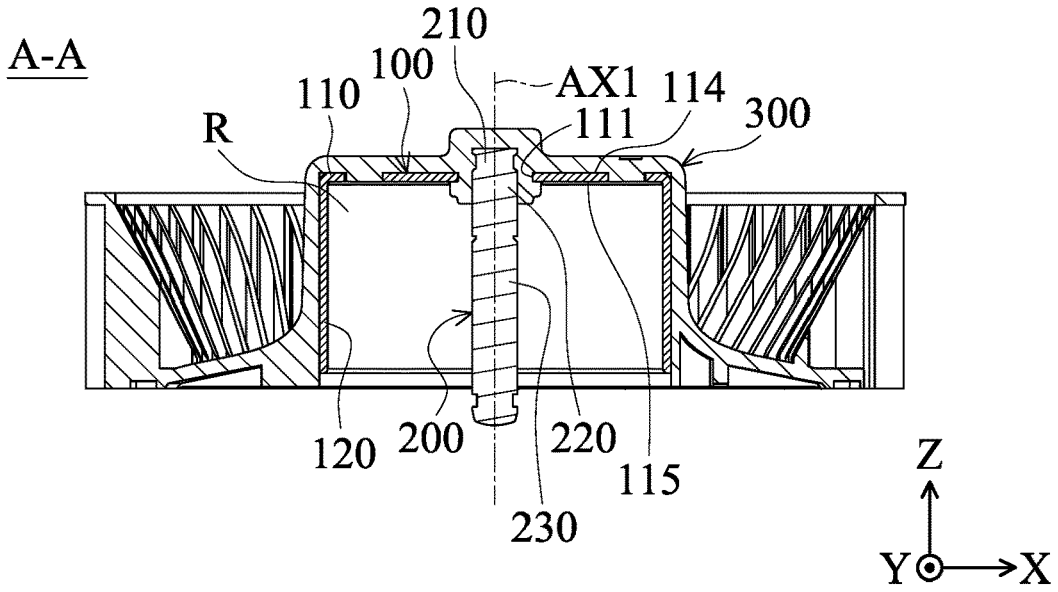
FIG. 3 is a cross-sectional view along line A-A in FIG. 1.
Figure 4A:
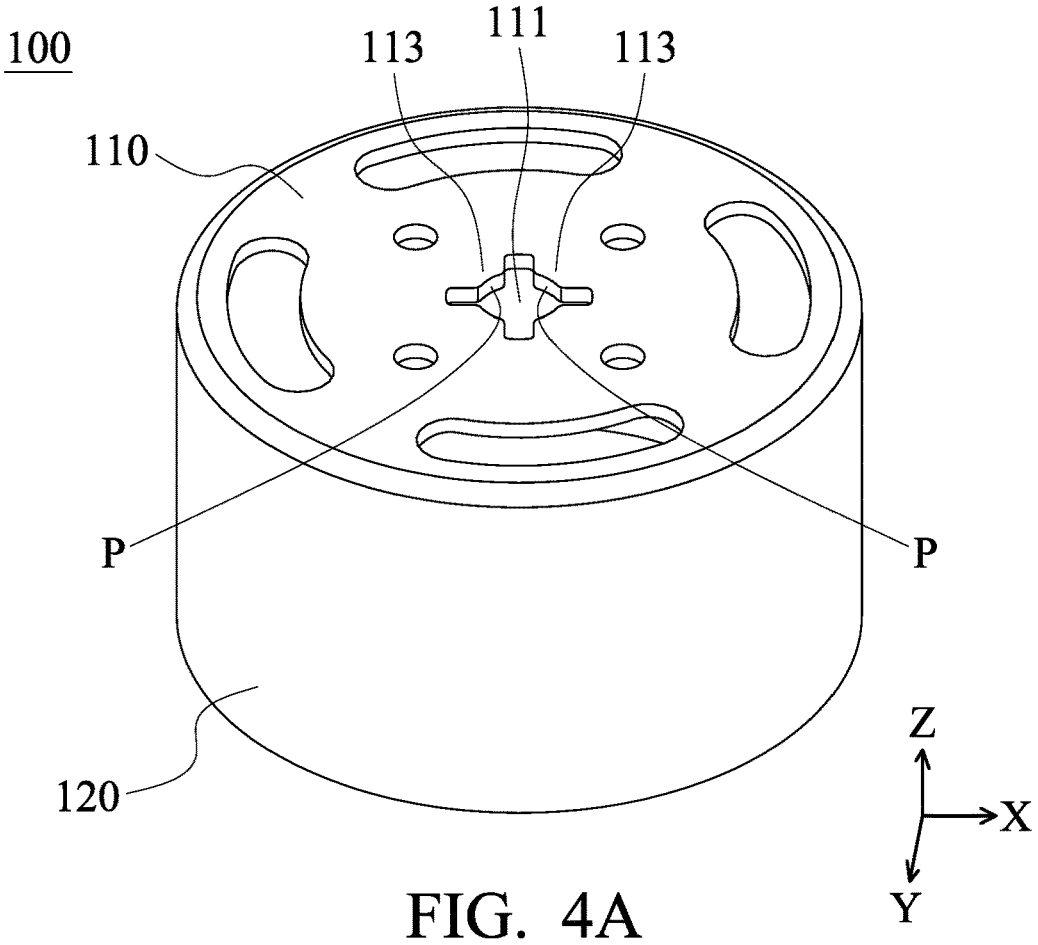
FIG. 4A is a schematic diagram of a metal housing according to an embodiment of the invention.
Figure 4B:
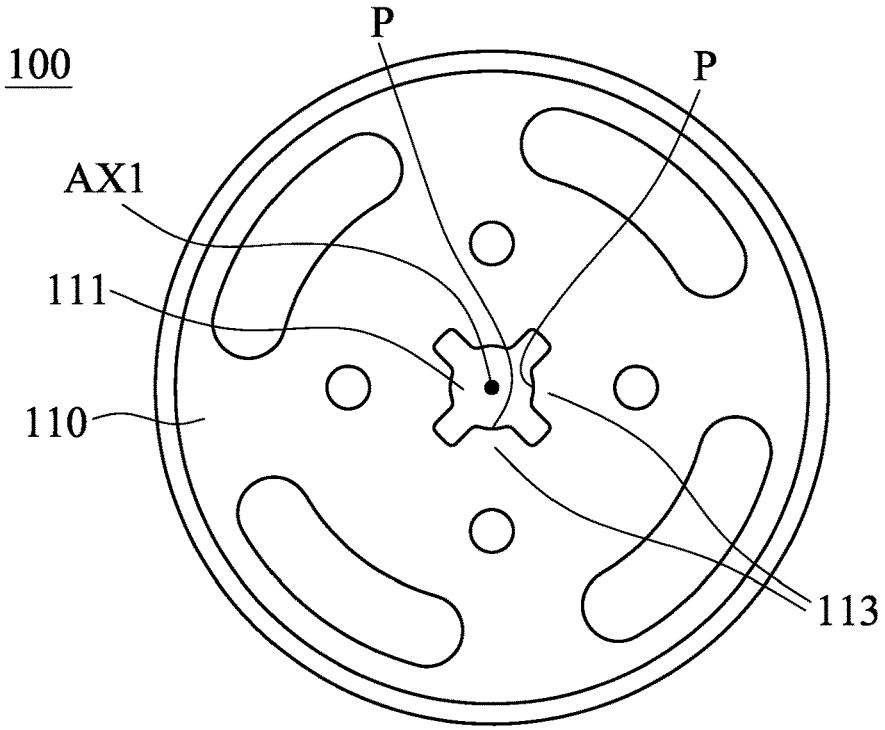
FIG. 4B is a top view of the metal housing according to an embodiment of the invention.

FIG. 3 is a cross-sectional view along line A-A in FIG. 1, and FIGS. 4A and 4B are schematic diagrams of the metal housing 100. Referring to FIGS. 2-4B, the metal housing 100 includes a plate 110 and a lateral wall 120. The lateral wall 120 is connected to the edge of the plate 110 and extended downwardly. Therefore, a cylindrical structure can be formed, and an accommodating space R can be constituted by the lateral wall 120 and the plate 110. The plate 110 has a shaft mounting hole 111 communicating with the accommodating space R.

Specifically, a plurality of contact portions 113 can be formed on the inner surface of the shaft mounting hole 111. The contact portions 113 are separated from each other, and each of the contact portions 113 has a contact point P. Furthermore, a virtual axis having the same distances away from all the contact points P can be defined as a main axis AX1 of the metal housing 100. Preferably, the contact points P are rotational symmetrically arranged relative to the main axis AX1.

Figure 5:
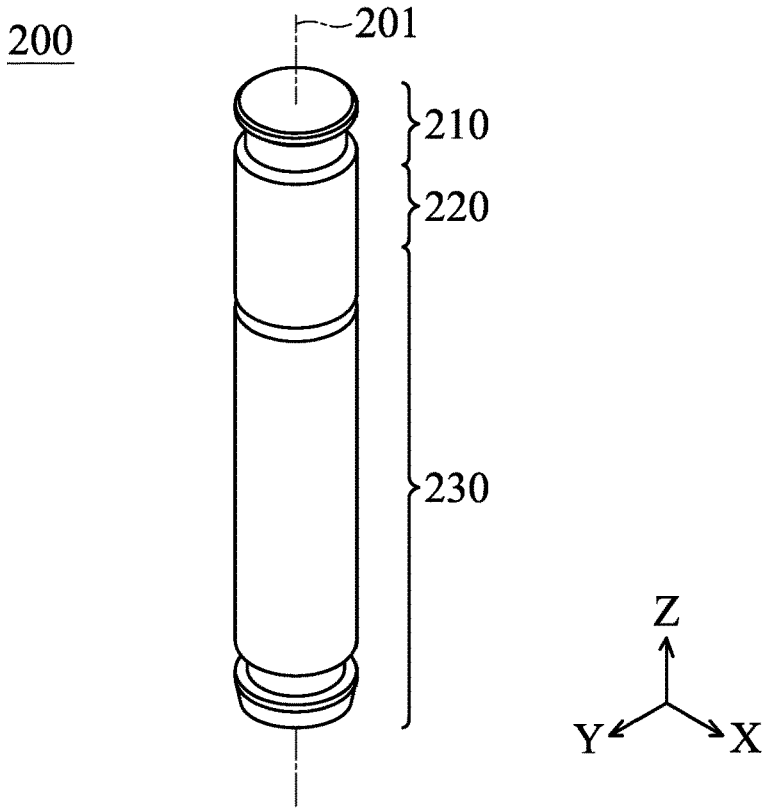
FIG. 5 is a schematic diagram of a shaft according to an embodiment of the invention.

Referring to FIGS. 2, 3, and 5, the shaft 200 passes through the shaft mounting hole 111 and is connected to the metal housing 100. The shaft 200 can be divided into an upper section 210, a middle section 220, and a lower section 230 along a central axis 201 of the shaft 200. When the shaft 200 passes through the shaft mounting hole 111 and is mounted on the metal housing 100, the upper section 210 protrudes from the upper surface 114 of the plate 110, the middle section 220 is accommodated in the shaft mounting hole 111, and the lower section 230 protrudes from the lower surface 115 of the plate 110 and is accommodated in the accommodating space R.

When the shaft 200 passes through the shaft mounting hole 111 and is mounted on the metal housing 100, the central axis 201 of the shaft 200 is substantially aligned with the main axis AX1 of the shat mounting hole 111. In this embodiment, the distance between the main axis AX1 and each of the contact points P of the contact portions 113 is preferably less than the radius of the shaft 200. Therefore, when the shaft 200 is mounted, the contact points P are closer to the shaft 200 than other portions of the inner surface of the shaft mounting hole 111, and the contact points P can be in contact with the middle section 220 of the shaft 200. When the contact points P are in contact with the middle section 220 of the shaft 200, they may be deformed to clamp and affix the shift 200. Owing to the contact portions 113 and the contact points P, the position of the shaft 200 relative to the metal housing 100 in the X-axis and the Y-axis can be affixed.

Preferably, the impeller 10 includes at least three contact portions 133 and contact points P to ensure that the position of the shaft 200 relative to the metal housing 100 in the X-axis and the Y-axis (in this embodiment, the impeller 10 includes four contact portions 133 and contact points P). Moreover, in this embodiment, the upper section 210 of the shaft 200 has a concave structure.

As shown in FIGS. 1-3, the plastic member 300 covers the metal housing 100 and is in contact with the metal housing 100 and the shaft 200. In detail, when the plastic member 300 is formed by overmolding, a portion of the plastic member 300 passes through the shaft mounting hole 111 and enters the accommodating space R. Therefore, the plastic member 300 is in contact with the middle section 220 of the shaft 200 and the inner surface of the shaft mounting hole 111, and the position of the shaft 200 relative to the metal housing 100 in the Z-axis can be affixed.

In this embodiment, the plastic member 300 is also in contact with at least a portion of the upper section 210 of the shaft 200, at least a portion of the lower section 230 of the shaft 200, and the upper surface 114 or lower surface 115 of the plate 110. Thus, the metal housing 100, the shaft 200, and the plastic member 300 can be affixed to each other steadily. In addition, when the plastic member 300 is attached on the concave structure of the upper section 210 of the shaft 200, the metal housing 100, the shaft 200, and the plastic member 300 can be affixed to each other more steadily.

Furthermore, embossing texture can be formed on the inner surface of the shaft mounting hole 111, the upper surface 114 of the plate 110, the lower surface 115 of the plate 110, or the shaft 200, so as to increase the surface roughness of the aforementioned portions. When the plastic member 300 is in contact with the aforementioned members, the plastic member 300 can be in contact with embossing texture, so that the engaged strength between the plastic member 300 and the metal housing 100 can be further enhanced.

Figure 8:
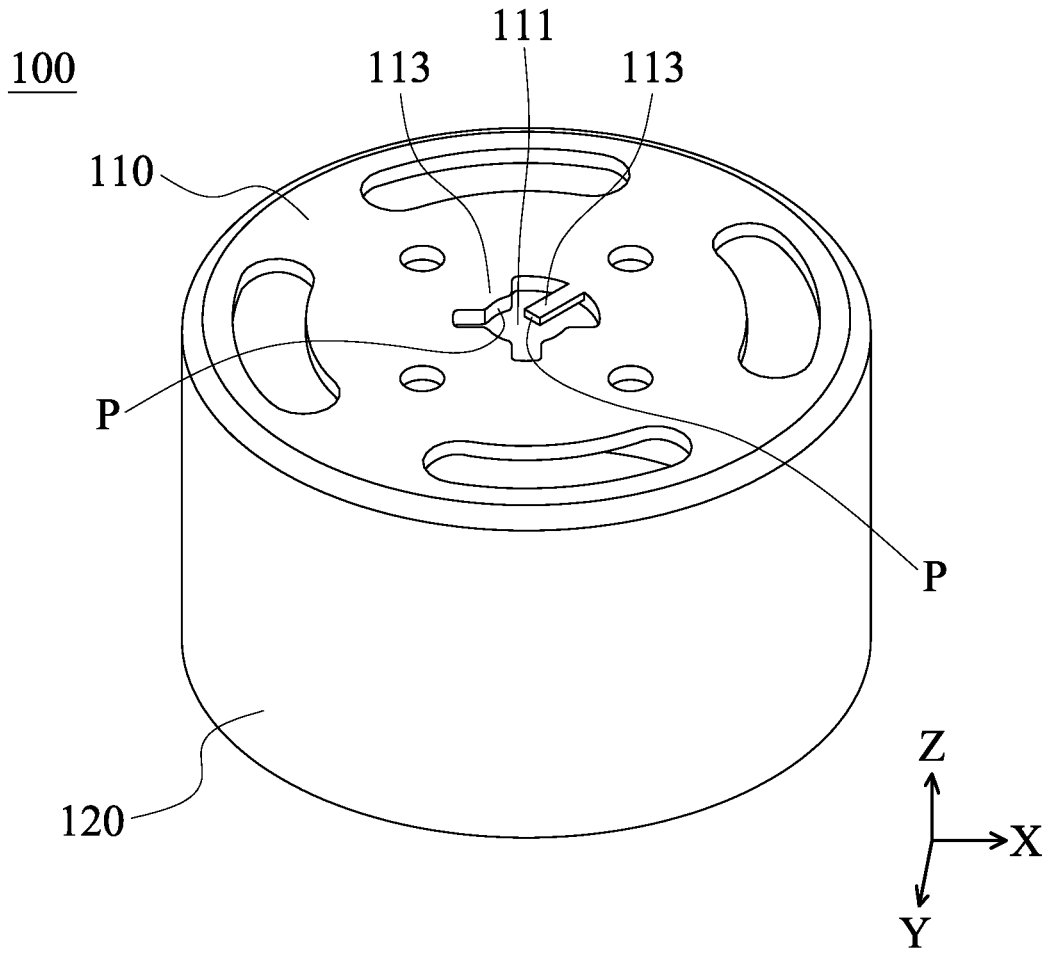
FIG. 8 is a schematic diagram of a metal housing according to another embodiment of the invention.

In this embodiment, each of the contact portions 113 include the same appearances and thicknesses, and the thicknesses of the contact portions 113 are less than that of the metal housing 100 at the periphery of the shaft mounting hole 111. In some embodiment, the contact portions 113 include different lengths, widths, and/or thicknesses (for example, in FIG. 8). In other words, the contact areas, the dimensions, and the shapes of the contact portions 113 can be different.

At the outer periphery of the plastic member 300, a plurality of blades 301 are formed. At least one rotator magnet is disposed in the metal housing 100. The rotator magnet and the driving module interact with each other, so as to rotate the blades 301. When the driving module is accommodated in the accommodating space R, the metal housing 100 can reduce the interference of the radiated emission.

Besides the aforementioned advantages, the automated production of the impeller can be achieved by using the plastic to directly affix the metal housing 100 and the shaft 200.

Figure 6:
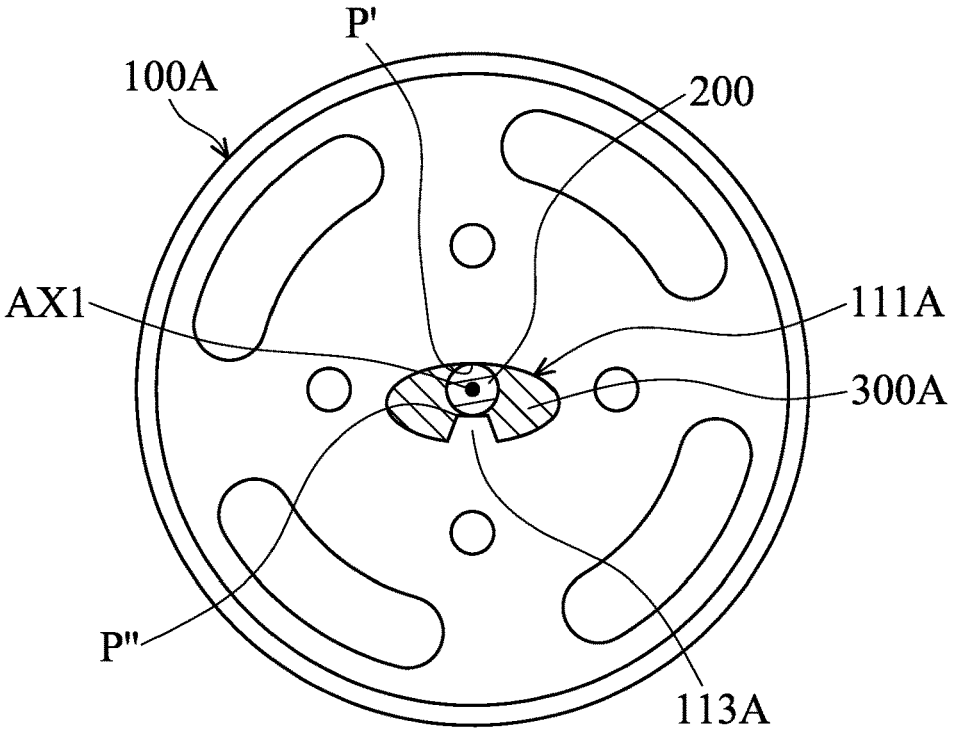
FIG. 6 is a schematic diagram of a metal housing and a shaft according to another embodiment of the invention.

The shaft mounting hole can include other appearance. Referring to FIG. 6, in another embodiment of the invention, the shape of the opening of the shaft mounting hole 111A is not circular, and at least one contact portion 113A can be formed on the inner surface of the shaft mounting hole 111A.

When the shaft 200 passes through the shaft mounting hole 111A and is mounted on the metal housing 100A, the shaft 200 is clamped by the contact point P" of the contact portion 113A and the contact point P' of the inner surface of the shaft mounting hole 111A. The contact point P" and the contact point P' is closer to the main axis AX1 of the metal housing 100A than other portions of the shaft mounting hole 111A.

When the shaft 200 passes through the shaft mounting hole 111A and is mounted on the metal housing 100A, the central axis 201 of the shaft 200 is substantially aligned with the main axis AX1 of the shaft mounting hole 111A. In this embodiment, the distance between the contact point P" of the contact portion 113A and the main axis AX1 is preferably slightly less than the radius of the shaft 200. Thus, when the shaft 200 is mounted, the contact portion 113A and/or the shaft mounting hole 111A is slightly deformed, and the shaft 200 can be clamped and affixed.

The plastic member 300A filled in the shaft mounting hole 111A can be in contact with the middle section 220 of the shaft 200 and the inner surface of the shaft mounting hole 111A, so as to affix the position of the shaft 200 relative to the metal housing 100A in the Z-axis.

In this embodiment, the shape of the opening of the shaft mounting hole 111A is oval, but it is not limited thereto. In some embodiments, the shape of the opening of the shaft mounting hole 111A can be triangular, square, rectangular, pentagonal, hexagonal, or other polygonal.

Figure 7:
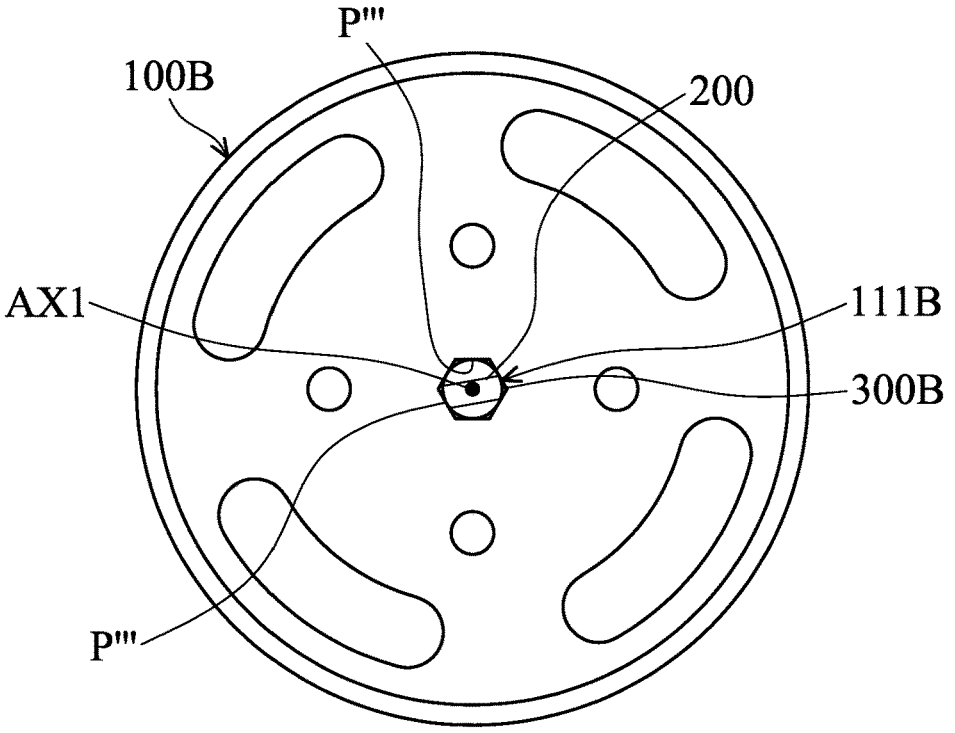
FIG. 7 is a schematic diagram of a metal housing and a shaft according to another embodiment of the invention.

Referring to FIG. 7, in some embodiments, the shape of the opening of the shaft mounting hole 111B is polygonal, and there is no contact portion formed on its inner surface. Specifically, the shape of the opening of the shaft mounting hole 111B is a regular polygon. Therefore, the shaft 200 can be in contact with every side of the polygon, and the contact points P"' can be formed at the contact positions. The main axis AX1 of the shaft mounting hole 111B passes through the center of the shaft mounting hole 111B, and the has same distances away from each of the contact points P"'. When the shaft 200 passes through the shaft mounting hole 111B and is mounted on the metal housing 100B, the central axis 201 of the shaft 200 is substantially aligned with the main axis AX1 of the shaft mounting hole 111B. In this embodiment, the distances between the contact points P"' and the main axis AX1 are slightly less than the radius of the shaft 200. Thus, when the shaft 200 is mounted, the contact points P"' are in contact with the middle section 220 of the shaft 200, the shaft mounting hole 111B is slightly deformed, and the shaft 200 can be clamped and affixed.

The plastic member 300B filled in the shaft mounting hole 111A can be in contact with the middle section 220 of the shaft 200 and the inner surface of the shaft mounting hole 111B, so as to affix the position of the shaft 200 relative to the metal housing 100B in the Z-axis.

In summary, an impeller is provided, including a metal housing, a shaft, and a plastic member. The metal housing has a shaft mounting hole. The inner surface of the shaft mounting hole includes three or more contact points, and the contact points are closer to the shaft than other portions of the inner surface of the shaft mounting hole. The shaft passes through the shaft mounting hole and is affixed by the contact points. The metal housing divides the shaft into an upper section, a middle section, and a lower section. The plastic member passes through the shaft mounting hole and is in contact with the middle section.

An impeller is also provided, including a metal housing, a shaft, and a plastic member. A contact portion is formed on the inner surface of the shaft mounting hole. The shaft passes through the shaft mounting hole and is affixed by the contact portion. The metal housing divides the shaft into an upper section, a middle section, and a lower section. The plastic member passes through the shaft mounting hole and is in contact with the middle section.

An impeller is further provided, including a metal housing, a shaft, and a plastic member. The metal housing has a shaft mounting hole. The opening of the shaft mounting hole is a polygonal opening. The shaft passes through the shaft mounting hole and is affixed by the shaft mounting hole. The metal housing divides the shaft into an upper section, a middle section, and a lower section. The plastic member passes through the shaft mounting hole and is in contact with the middle section.

Although some embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, compositions of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. Moreover, the scope of the appended claims should be accorded the broadest interpretation so as to encompass all such modifications and similar arrangements.

While the invention has been described by way of example and in terms of preferred embodiment, it should be understood that the invention is not limited thereto. On the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. An impeller, comprising:

a metal housing, having a shaft mounting hole;

a shaft, passing through the shaft mounting hole, wherein a portion of an inner surface of the shaft mounting hole is in contact with the shaft; and a plastic member, connected to the shaft and a remaining portion of the inner surface of the shaft mounting hole that is not in contact with the shaft.

2. The impeller as claimed in claim 1, wherein the portion of the inner surface of the shaft mounting hole is in contact with the shaft in two or more separated contact points.

3. The impeller as claimed in claim 2, wherein the contact points are formed on a plurality of contact portions of the metal housing, and the contact areas, the dimensions, or the shapes of the contact portions are different.

4. The impeller as claimed in claim 2, wherein the contact points are formed on a plurality of contact portions of the metal housing, and the lengths, the widths, or the thicknesses of the contact portions are different.

5. The impeller as claimed in claim 1, wherein an embossing texture is formed on the shaft or the inner surface, and at least a portion of the embossing texture is in contact with the plastic member.

6. The impeller as claimed in claim 1, wherein the metal housing divides the shaft into an upper section, a middle section, and a lower section, and the plastic member is in contact with the middle section and extended to contact at least a portion of the upper section or a portion of the lower section.

7. The impeller as claimed in claim 1, wherein the metal housing has an upper surface and a lower surface opposite to the upper surface, and the plastic member is further in contact with the upper surface and the lower surface.

8. The impeller as claimed in claim 1, wherein a shape of an opening of the shaft mounting hole is polygonal.

9. An impeller, comprising:

a metal housing, having a shaft mounting hole and a contact portion;

a shaft, passing through the shaft mounting hole and affixed by the contact portion, wherein a portion of an inner surface of the shaft mounting hole is in contact with the shaft; and a plastic member, connected to the shaft and a remaining portion of the inner surface of the shaft mounting hole that is not in contact with the shaft, wherein a thickness of the contact portion is less than an average thickness of the metal housing.

10. The impeller as claimed in claim 9, wherein the metal housing has a plurality of separated contact portions, the shaft is affixed by the contact portions, and the contact areas, the dimensions, or the shapes of the contact portions are different.

11. The impeller as claimed in claim 9, wherein the metal housing has a plurality of separated contact portions, the shaft is affixed by the contact portions, and the lengths, the widths, or the thicknesses of the contact portions are different.

12. The impeller as claimed in claim 9, wherein a shape of an opening of the shaft mounting hole is polygonal.

13. The impeller as claimed in claim 9, wherein an embossing texture is formed on the shaft or the inner surface, and at least a portion of the embossing texture is in contact with the plastic member.

14. The impeller as claimed in claim 9, wherein the metal housing divides the shaft into an upper section, a middle section, and a lower section, and the plastic member is in contact with the middle section and extended to contact at least a portion of the upper section or a portion of the lower section.

15. The impeller as claimed in claim 9, wherein the metal housing has an upper surface and a lower surface opposite to the upper surface, and the plastic member is further in contact with the upper surface and the lower surface.

* * * * *